US005959591A

United States Patent [19]

Aurand

[11] Patent Number: 5,959,591

[45] Date of Patent: Sep. 28, 1999

[54] TRANSVERSE ELECTROMAGNETIC HORN ANTENNA WITH RESISTIVELY-LOADED EXTERIOR SURFACES

[75] Inventor: John F. Aurand, Edgewood, N.Mex.

[73] Assignee: Sandia Corporation, Albuquerque, N.Mex.

[21] Appl. No.: 08/915,131

[22] Filed: Aug. 20, 1997

[51] Int. Cl.[6] ..... H01Q 13/00

[52] U.S. Cl. ..... 343/786; 343/753

[58] Field of Search ..... 343/753, 772, 343/786; 33/21 R, 135, 137

[56] References Cited

U.S. PATENT DOCUMENTS

| | | | |
|---|---|---|---|
| 2,297,202 | 9/1942 | Dallenback et al. | 250/11 |
| 2,454,766 | 11/1948 | Brillouin | 484/335 |
| 2,591,486 | 4/1952 | Wilkinson, Jr. | 343/786 |
| 2,592,486 | 4/1952 | Wilkinson, Jr. | 250/33 |
| 2,946,999 | 7/1960 | Kelleher et al. | 343/786 |
| 2,996,715 | 8/1961 | Rumsey et al. | 343/786 |
| 3,099,836 | 7/1963 | Carr | 343/753 |
| 3,312,975 | 4/1967 | Huelskamp | 343/760 |
| 3,400,404 | 9/1968 | Kreutel, Jr. | 343/784 |
| 3,406,398 | 10/1968 | Beguin | 343/16 |
| 3,831,176 | 8/1974 | Epis et al. | 343/756 |
| 4,410,866 | 10/1983 | Bui-Hai | 333/135 |
| 4,660,050 | 4/1987 | Phillips | 343/786 |
| 4,811,027 | 3/1989 | Wichmann | 343/776 |
| 5,325,105 | 6/1994 | Cermignani et al. | 343/786 |
| 5,440,316 | 8/1995 | Podgorski et al. | 343/786 |
| 5,471,223 | 11/1995 | McCorkle | 343/786 |
| 5,606,331 | 2/1997 | McCorkle | 343/786 |
| 5,640,168 | 6/1997 | Heger et al. | 343/786 |

*Primary Examiner*—Hoanganh Le
*Assistant Examiner*—Tan Ho
*Attorney, Agent, or Firm*—V. Gerald Grafe

[57] ABSTRACT

An improved transverse electromagnetic (TEM) horn antenna comprises a resistive loading material on the exterior surfaces of the antenna plates. The resistive loading material attenuates or inhibits currents on the exterior surfaces of the TEM horn antenna. The exterior electromagnetic fields are of opposite polarity in comparison to the primary and desired interior electromagnetic field, thus inherently cause partial cancellation of the interior wave upon radiation or upon reception. Reducing the exterior fields increases the radiation efficiency of the antenna by reducing the cancellation of the primary interior field (supported by the interior surface currents). This increases the transmit gain and receive sensitivity of the TEM horn antenna, as well as improving the transient (time-domain) response.

17 Claims, 6 Drawing Sheets

TRANSVERSE ELECTROMAGNETIC HORN ANTENNA WITH RESISTIVELY-LOADED EXTERIOR SURFACES

This invention was made with Government support under Contract DE-AC04-94AL85000 awarded by the U.S. Department of Energy. The Government has certain rights in the invention.

BACKGROUND OF THE INVENTION

This invention relates to the field of electromagnetic radiators, specifically transverse electromagnetic (TEM) horn antennas.

TEM horn antennas employ the transverse electromagnetic mode of operation, which means that both the electric field and the magnetic field are transverse (perpendicular) to the direction of wave propagation in or along the antenna structure. TEM horn antennas have a well defined time-domain behavior as a two-conductor smoothly expanding traveling-wave structure. As a transmitting antenna, a TEM horn guides the desired electromagnetic wave from the feedpoint to the aperture, where the wave then breaks away and radiates into space, forming an endfire radiation pattern. As a receiving antenna, a TEM horn intercepts an incident electromagnetic wave and generates an induced current which can then be measured by an instrument connected to the feedpoint.

Because of the well-behaved traveling-wave behavior of TEM horns, they offer very fast transient (time-domain) response, and correspondingly ultra-wideband frequency-domain operation (with low phase dispersion). This phase response is much less dispersive than other types of horn antennas, which utilize a single conductor waveguide topology. A single conductor waveguide structure prohibits a TEM mode of operation, limiting the electromagnetic operation to either transverse electric modes, transverse magnetic modes, or a hybrid combination of both. The most non-dispersive and frequency-independent electromagnetic operation is achieved with the TEM mode, meaning that TEM horn antennas offer the best wideband performance of horn antennas. This makes them attractive in communications or radar systems which are ultra-wideband in nature (i.e., multiple octaves or decades of bandwidth). The wideband operation provides increased information content, meaning higher data rates in communications applications and increased (or finer) range resolution in radar applications.

TEM horn antennas typically incorporate long flat triangularly shaped conducting plates which separate or spread apart at some constant angle. However, they may employ exponential (or other shaped) flaring in plate width or plate separation or both. Examples of the constant taper type include McCorkle, U.S. Pat. Nos. 5,471,223 and 5,606,331, and Heger et al., U.S. Pat. No. 5,640,168. Examples of the flared type include Brillouin, U.S. Pat. No. 2,454,766, Wichmann, U.S. Pat. No. 4,811,027, and Cermignani et al., U.S. Pat. No. 5,325,105. Both types are included in Carr, U.S. Pat. No. 3,099,836, and Podgorski and Gibson, U.S. Pat. No. 5,440,316. The exact transverse shaping of the antenna plates (including their cross-sectional shape) and their separation along the length of the antenna determine both the characteristic impedance (or surge impedance) variation along the structure and also the radiation properties of the antenna.

In addition, TEM horn antennas can incorporate aperture lenses to collimate the spherical wavefront inside the two conductor expanding structure, in order to improve the transient response and higher frequency gain characteristic. See, e.g., Carr, U.S. Pat. No. 3,099,836.

TEM horn antennas can also employ resistive loading in order to reduce the ringing of the antenna currents up and down the structure. This resistive loading may be incorporated in one of two different manners: either continuously distributed along each of the two conductive plates (from the feedpoint out to the aperture on both the interior and exterior surfaces), or located at the aperture end of the conductive plates (as either parallel plate extensions or discrete resistive terminations of the aperture currents). The aperture-connected resistive loading implementation is described in Wichmann, U.S. Pat. No. 4,811,027, Podgorski and Gibson, U.S. Pat. No. 5,440,316, and McCorkle, U.S. Pat. Nos. 5,471,223 and 5,606,331. In all cases the express intent and purpose of the resistive loading has been to attenuate the outgoing traveling currents on the conducting plates in order to reduce the subsequent ringing of the TEM horn.

Unfortunately, none of the above variations of TEM horn antennas have addressed a fundamental problem in the inherent design of the TEM horn structure: the existence of oppositely polarized electromagnetic fields on the exterior surfaces of the antenna plates, and the consequent reduction in main-beam transmit gain and receive sensitivity due to partial field cancellation of the primary interior electromagnetic wave supported in between the antenna plates.

Consequently, the need exists for a TEM horn design which directly addresses the fundamental problem of oppositely directed electromagnetic fields and currents on the exterior surfaces of the antenna plates, in order to achieve an inherently more efficient radiating antenna structure due to the reduction or elimination of these exterior fields.

SUMMARY OF THE INVENTION

The present invention provides a TEM horn antenna with inherently better radiation efficiency (and consequently higher transmit gain and receive sensitivity), as well as better transient response, than previous TEM horn antennas. TEM horn antennas comprise two conductive plates, with an electric field imposed between the conductive plates. Electromagnetic fields induce electric currents on both the interior and exterior surfaces of the conductive plates. Currents on the interior surfaces contribute to the desired or intended electromagnetic field. Currents on the exterior surfaces result in an electromagnetic field with polarity opposite to the field associated with the interior surface currents. Upon summation of the radiated fields into space from a transmit antenna, or of the induced currents at the feedpoint from a receive antenna, this oppositely directed field decreases the overall radiation performance of the antenna. The present invention adds resistive loading to the exterior surfaces of the conductive plates. The resistive loading attenuates or inhibits exterior surface currents, thereby increasing the efficiency of the energy transfer to or from the antenna, and consequently increasing the gain of the antenna. In addition, this external current reduction improves the time-domain response of the antenna.

Advantages and novel features will become apparent to those skilled in the art upon examination of the following description or may be learned by practice of the invention. The objects and advantages of the invention may be realized and attained by means of the instrumentalities and combinations particularly pointed out in the appended claims.

DESCRIPTION OF THE FIGURES

The accompanying drawings, which are incorporated into and form part of the specification, illustrate embodiments of the invention and, together with the description, serve to explain the principles of the invention.

DETAILED DESCRIPTION OF THE INVENTION

The present invention provides an improved TEM horn antenna that offers enhanced radiation efficiency (transmit gain and receive sensitivity) over previous TEM horn antennas.

Figure 1A:
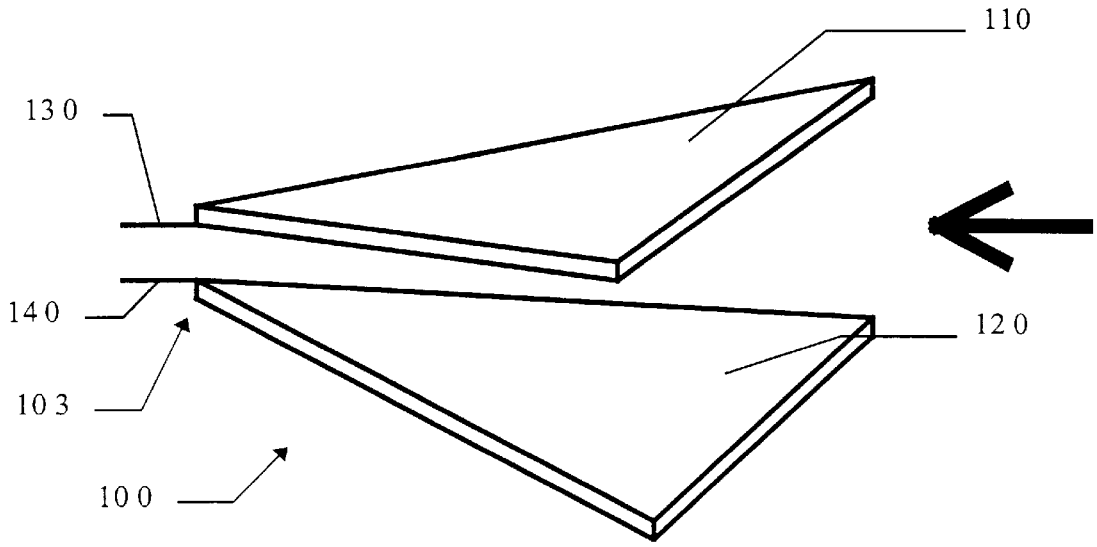
Figure 1a (prior art)
FIGS. 1*a* and 1*b* are views of a conventional TEM horn antenna.
Figure 1B:
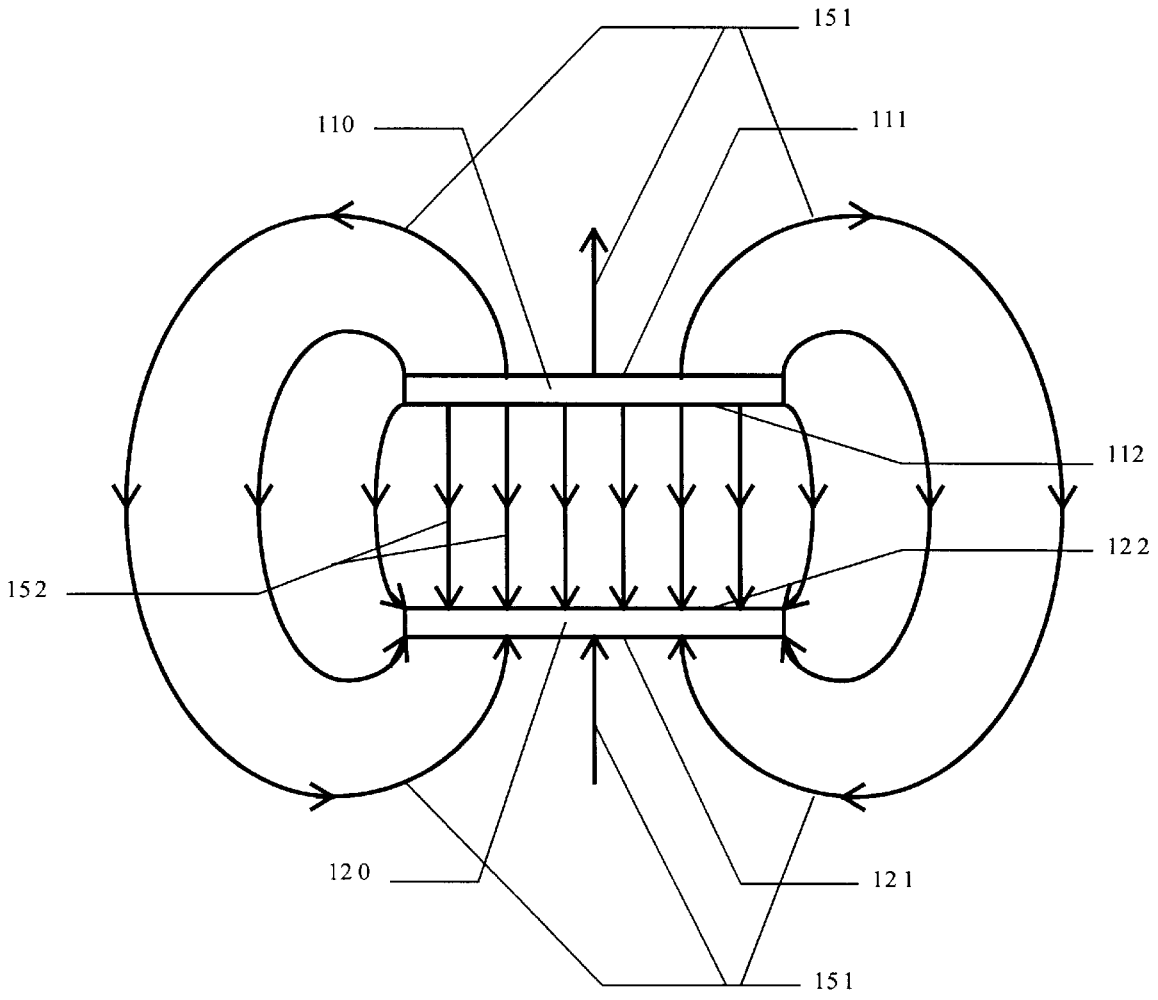
Figure 1b (prior art)

FIGS. 1*a* and 1*b* show a conventional TEM horn antenna 100. The flat plate geometry (with constant plate width and plate separation angles) shown in FIG. 1*a* is for illustration purposes; those skilled in the art will appreciate many possible TEM horn antenna configurations. The discussion of operation of the TEM horn antenna is in terms of transmission; those skilled in the art will appreciate that reception operation follows similar principles and thus has similar characteristics.

A microwave or radio frequency generator (not shown) connects to feedpoint 103, comprising terminals 130, 140, which in turn connect with upper conductive plate 110 and lower conductive plate 120, respectively. An electromagnetic signal imposed across terminals 130, 140 will propagate through antenna 100, radiating when it reaches the ends of the conductive plates 110, 120.

FIG. 1*b* shows the aperture end of the antenna in FIG. 1*a*, as indicated by the arrow in FIG. 1*a*. Currents flowing through conductive plates 110, 120 are distributed about the surfaces of plates 110, 120, with part of the currents on exterior surfaces 111, 121, and part of the currents on interior surfaces 112, 122. The charges associated with currents on interior surfaces 112, 122 result in a transverse electric field between the conductive plates 110, 120 represented by field lines 152. The charges associated with currents on exterior surfaces 111, 121 result in a transverse electric field external to conductive plates 110, 120 represented by field lines 151. An observation point (not shown) away from the antenna therefore experiences two oppositely polarized radiated electromagnetic fields due to electric fields 151, 152. Electric field 152 represents the desired electromagnetic wave; electric field 151 reduces the antenna efficiency by partially canceling the desired electric field 152.

Figure 2A:
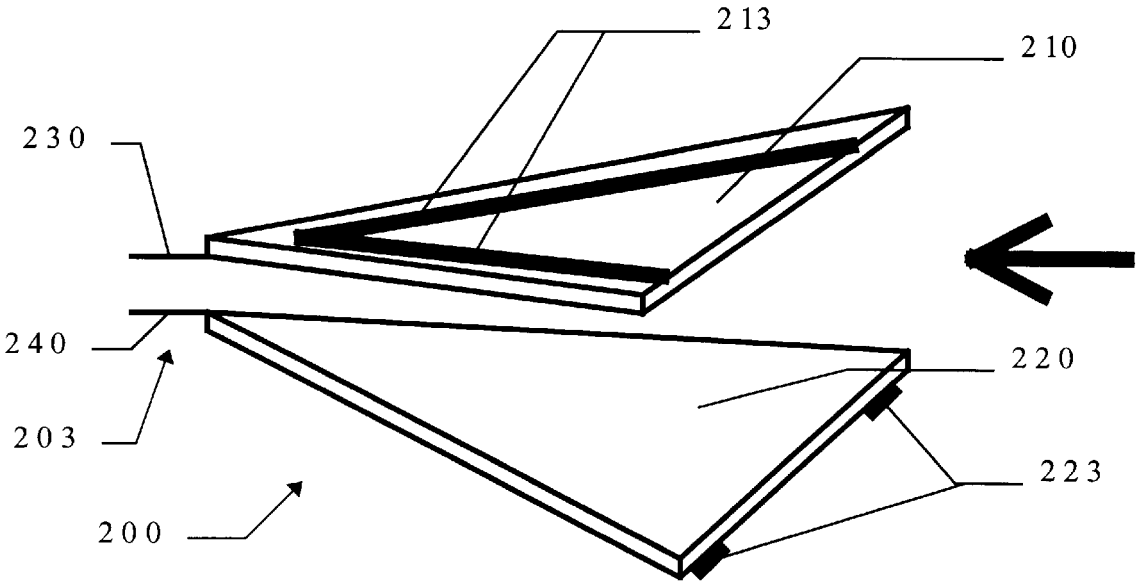
FIGS. 2*a* and 2*b* are views of a TEM horn antenna according to the present invention.

FIG. 2*a* shows a perspective view of a TEM horn antenna 200 according to the present invention. The plate geometry shown is for illustration purposes; those skilled in the art will appreciate many possible TEM horn antenna configurations. For example, the conductive plates can have monotonically increasing plate width angles, exponential plate width angles, or other plate shapes. The separation angle between the conductive plates can be constant, monotonically increasing, or exponentially increasing. The conductive plates themselves can be substantially planar, or can have substantially flat cross-section, or can have convex cross-sections (e.g., circular or elliptical), or other cross-sections where the cross-section includes transverse width that is substantial relative to the plate separation (e.g., portions of the surface of a cone). A microwave or radio frequency generator (not shown) connects to feedpoint 203, comprising terminals 230, 240, which in turn connect with upper conductive plate 210 and lower plate 220, respectively. An electromagnetic wave imposed across terminals 230, 240 will propagate through antenna 200, radiating when it reaches the ends of the conductive plates 210, 220. Strips 213, 223 of a resistive loading material mount onto the external surfaces of conductive plates 210, 220.

Figure 2B:
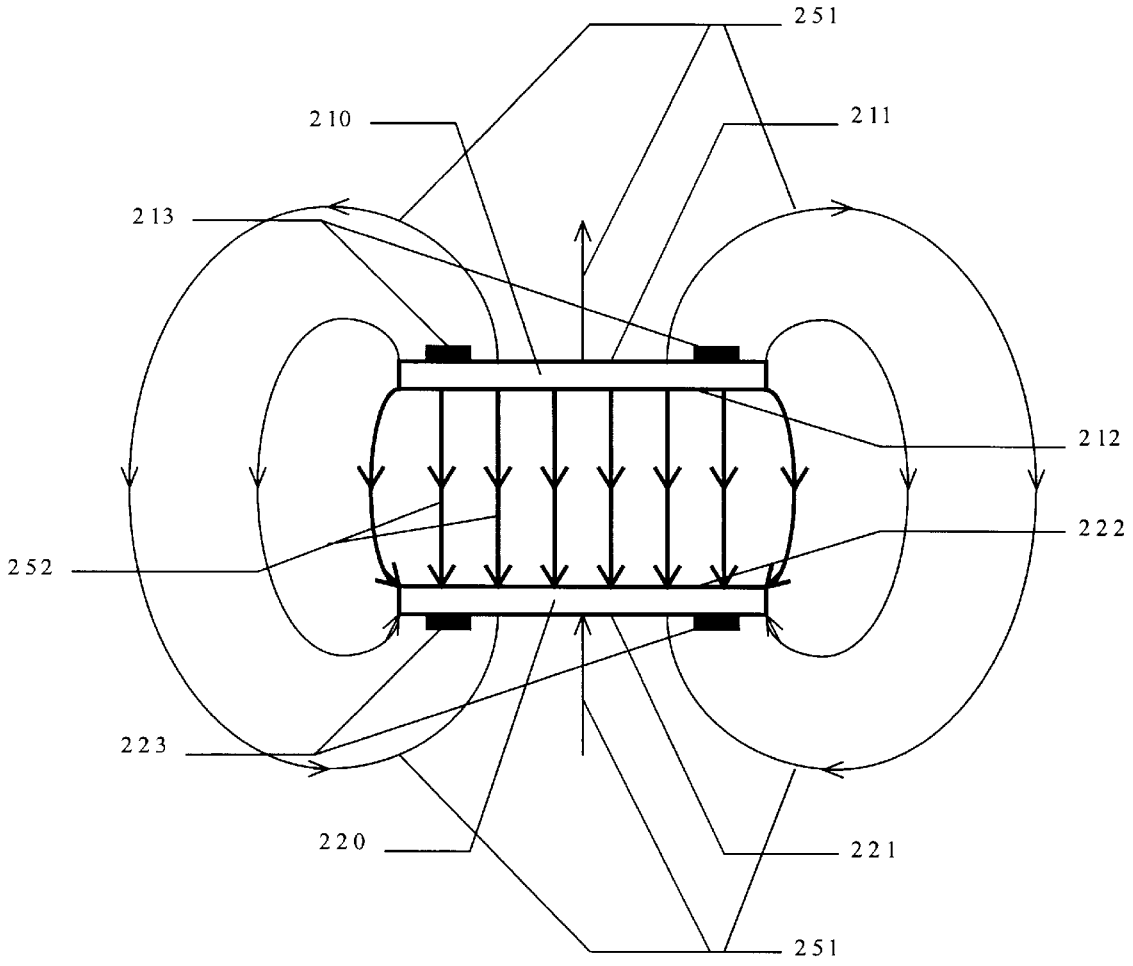

FIG. 2*b* shows the aperture end of the antenna in FIG. 2*a*, as indicated by the arrow in FIG. 2*a*. Currents flowing through conductive plates 210, 220 are distributed about the surfaces of conductive plates 210, 220, with part of the currents on exterior surfaces 211, 221, and part of the currents on interior surfaces 212, 222. The charges associated with currents on interior surfaces 212, 222 result in a transverse electric field between conductive plates 210, 220 represented by field lines 252. The charges associated with currents on exterior surfaces 211, 221 result in a transverse electric field exterior to conductive plates 210, 220 represented by field lines 251. An observation point (not shown) away from the antenna therefore sees two opposite electromagnetic waves, due to the radiation of electric fields 251, 252. Electric field 252 represents the desired electromagnetic wave; electric field 251 reduces the antenna efficiency by partially canceling the desired electric field 252.

Strips 213, 223 of resistive loading material attenuate or inhibit currents on exterior surfaces 211, 221 of conductive plates 210, 220, thereby reducing electric field 251. This reduces the partial cancellation of the desired interior electromagnetic wave 252, directly resulting in increased antenna efficiency. Antenna 200 therefore has a higher transmit gain (and receive sensitivity) than it would have without resistive loading strips 213, 223.

The resistive loading material is shown in FIGS. 2*a* and 2*b* in the form of resistive loading strips attached to the exterior surfaces of conductive plates 210, 220, oriented parallel to the conductive plate side edges, running most of the length of the conductive plates. This has been experimentally found to be an acceptable form of the resistive loading material. The resistive loading material 213, 223 has also been used in the form of triangular sheets, centered on the exterior conductive plate surfaces; the strip form merely consists of the edge portions of such a triangular form. The resistive loading material may be solid ferrite tiles, or carbon-loaded lossy foam absorber, or another lossy microwave material (e.g., ferrite- or carbon-particle loaded coatings, or thick-film carbon sheet). The design concept for this resistive loading material is that it interact with and attenuate the exterior surface current on the conductive plates (or, equivalently, the magnetic fields associated with these currents).

The preferred placement and form of the resistive loading material depends on the surface current density on the exterior conductive plate surfaces. Most of the exterior current flows along the side edges of the conductive plates, with relatively little in the middle portion of the conductive plate width. This transverse distribution of current density can be theoretically determined from the corresponding charge distribution from the electrostatic analysis of the TEM horn plates as a capacitive structure. Because most of the exterior current flows near the side edges of the conductive plates, it was experimentally determined that strips 213, 223 of resistive loading material were sufficient to successfully attenuate the exterior current, rather than a full width of triangularly-formed resistive loading material. The actual cross-section width and height of resistive loading material is determined from the loss properties of the resistive loading material being used, and should be large enough in cross-sectional area so as to provide sufficient attenuation of the exterior fields (the attenuation is proportional to the amount of resistive loading material).

The preferred placement of the resistive loading material is for the outside edges of the material (in either triangular form or strip form) to be slightly inside the side edges of the conductive plates 210, 220. This permits acceptable interaction with the intended exterior field 251 (causing the desired attenuation), but prevents interaction with the fringing field portion of interior field 252. If the resistive loading material is placed such that its outside edges are right at the side edges of the conductive plates 210, 220, then some attenuation of interior field 252 will occur as well. This can be detrimental. Consequently, the preferred placement of the outside edges of the resistive loading material is slightly inside the side edges of the conductive plates on which it is mounted; the specific positioning can be easily determined in an experimental fashion for a given TEM horn. The other placement issue is that of the longitudinal dimension (along the length of the conductive plates, from feedpoint out to the aperture). The preferred placement of the resistive loading material is from the aperture end of the conductive plates 210, 220, back down toward but not entirely to the feedpoint 203. The resistive loading material should be kept away from the feedpoint 203 for the same reason it is kept away from the side edges of the conductive plates 210, 220: it will interact with and detrimentally attenuate some of the main desired antenna current going to the feedpoint terminals 230, 240. A suggested rule of thumb would be to make the length of the resistive loading material to be about 80% of the length of conductive plates 210, 220, with the aperture end of the material placed at the aperture end of the conductive plates 210, 220.

EXAMPLE

An example TEM horn antenna according to the present invention is described to help illustrate the principles of the present invention.

Figure 3:
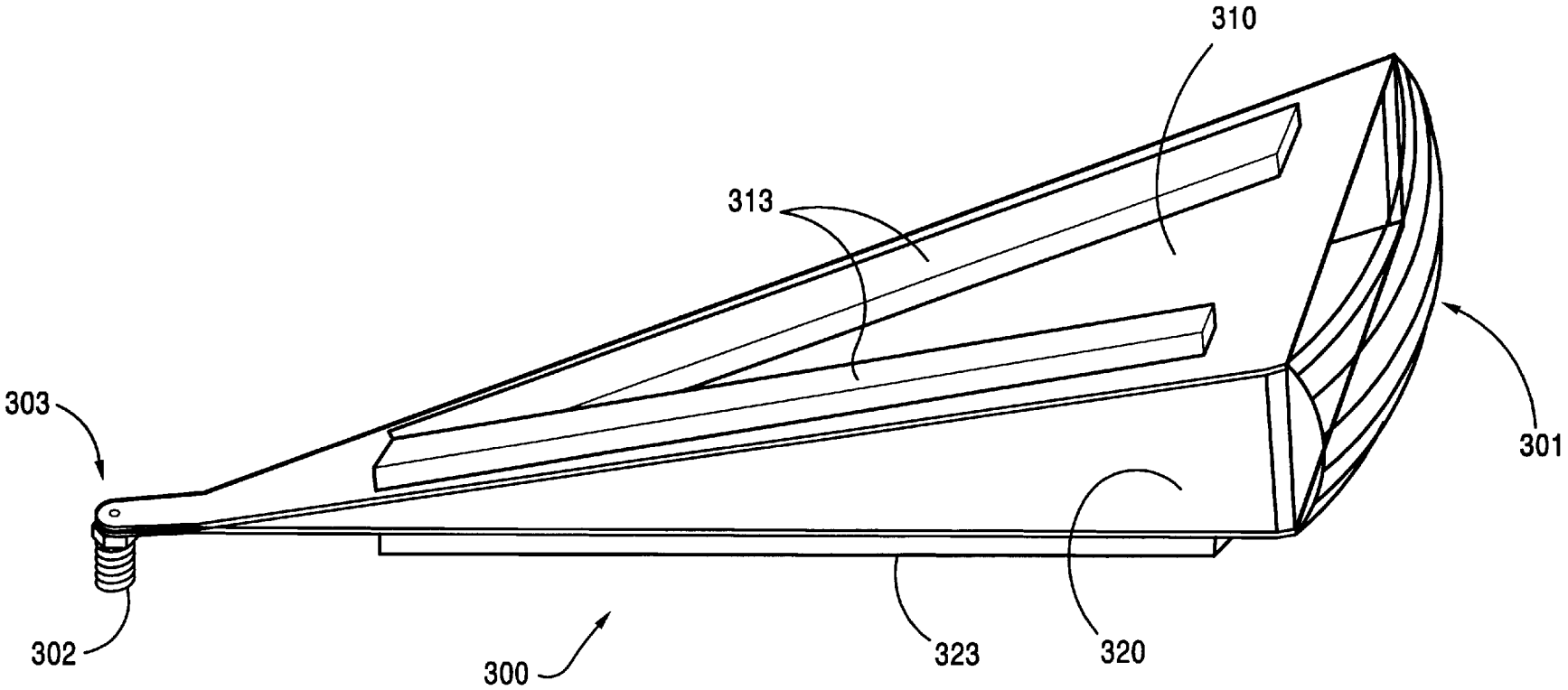
FIG. 3 is a perspective view of an example TEM horn antenna according to the present invention.

FIG. 3 shows a perspective view of a TEM horn antenna according to the present invention. Antenna 300 comprises two flat, 91-cm long triangularly-shaped conductive plates 310, 320 with 30-cm aperture width and 12.7-cm aperture separation. There is a constant separation angle of 9° between conductive plates 310, 320 and a constant plate width angle of 22° (where the plate width angle is the angle between the diverging side edges of the conductive plate). A solid plano-convex dielectric lens 301 mounts between the aperture ends of conductive plates 310, 320, and collimates the interior wave for a faster time-domain response. Lens 301 is machined with a planar interior surface and spherical exterior surface (approximating a traditional hyperbolic lens) out of polytetrafluoroethylene plastic. The surge characteristic impedance smoothly varies from 50 Ω at the feedpoint to about 95 Ω at the aperture (designed for higher gain with a given plate aperture width). Feedpoint 303 comprises a female SMA coaxial adapter 302 which is soldered to plates 310, 320 in such a manner as to form a transverse-directed coaxial to parallel-plate transmission line transition.

Two long, narrow strips 313, 323 of carbon-loaded lossy-foam absorber mount on the exterior surface of each conductive plate 310, 320, with outside edges placed 0.6-cm inside the side edges of the conductive plates 310, 320. The strips are 61-cm long, 2.5-cm wide, and 2.0-cm high.

Figure 4:
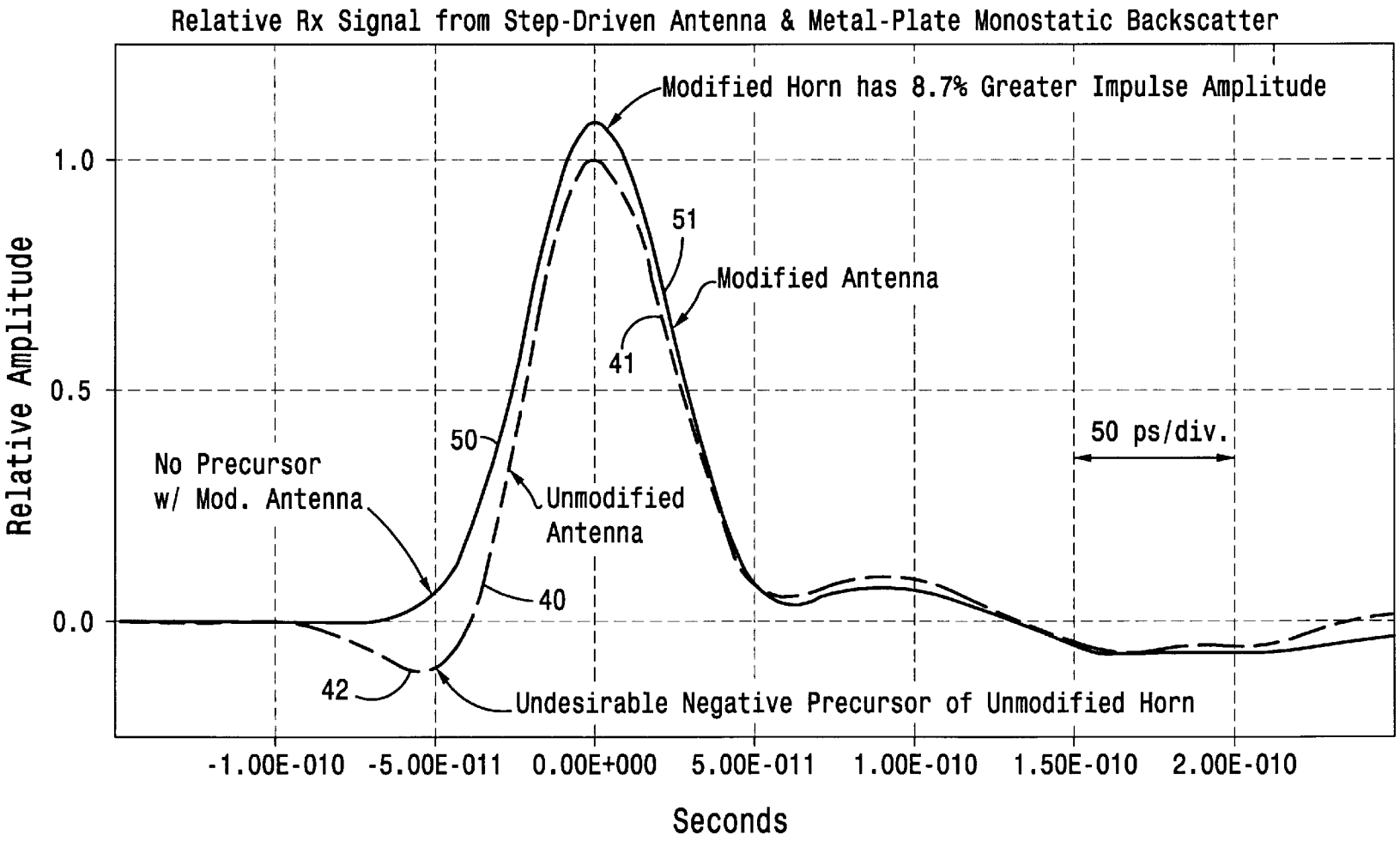
FIG. 4 is a view of the time-domain monostatic backscatter response from a flat metal plate reflector for both a conventional TEM horn antenna and a TEM horn according to the present invention.

The beneficial effect of the resistive strips is illustrated by FIG. 4, showing the time-domain antenna performance with and without the resistive strips. An experiment was made to measure the performance of the antenna in FIG. 3. This was done using a pair of identical conventional TEM horns, one of which was modified by the addition of resistive strips. This experiment utilized a very fast step pulse generator and a 20-GHz loop-through sampling oscilloscope in conjunction with the antenna under test to radiate an ultra-wideband impulsive transient wave, reflect this electromagnetic wave off a flat metal plate reflector, and then receive the scattered wave and measure the time-domain receive response. It therefore functioned as a time-domain monostatic backscatter radar system. The radar system used an unmodified TEM horn, and the measurements were acquired. Then the modified TEM horn was used instead, and the measurements were again acquired. This provides a direct comparison of the transmit-receive transient step response of the example antenna with and without the added resistive strips.

In FIG. 4, waveform 40 is the response of the unmodified antenna (without resistive strips) and waveform 50 is that of the modified antenna (with resistive loading strips). Both waveforms show a primary impulsive response 41, 51, which is the expected receive signal. That is, each TEM horn radiates a time derivative of the generator excitation, the plate target reflects a negative replica of the incident wave, and then the TEM horn receives a replica of the scattered wave. This results in a negative-going impulsive wave from the step generator excitation. The difference between the waveforms 40, 50 is in the detailed features of these impulsive receive signals. The unmodified antenna response waveform 40 (without resistive strips) shows a negative precursor 42 to the primary impulsive response 41. Negative precursor 42 represents the effect of the exterior surface currents; the dielectric lens delays the primary response (carried by the interior surface currents), so the opposite polarity exterior fields arrive earlier in time. If the lens was not present, this negative feature would arrive at the same time as the primary internal current response, thus decreasing its amplitude (meaning that the main beam gain and sensitivity is reduced).

The modified antenna response waveform 50 (with strips) in FIG. 4 shows the primary impulsive response 51 with no negative precursor. The resistive loading strips have attenuated the exterior surface current relative to the interior surface current, effectively eliminating the negative precursor. In addition, the modified horn, with resistive loading strips, has significantly increased primary impulsive response 51, indicating that the gain and sensitivity have demonstrably improved. Detailed comparison of these responses 41, 51 also indicates that the impulsive time duration (at half-amplitude level) has been preserved (52 ps), showing that the addition of appropriately designed resistive loading material has not degraded the very fast transient performance of the TEM horn antenna. This means that there is no performance disadvantage in utilizing the present invention.

The particular sizes and equipment discussed above are cited merely to illustrate particular embodiments of the invention. It is contemplated that the use of the invention may involve components having different sizes and characteristics. It is intended that the scope of the invention be defined by the claims appended hereto.

We claim:

1. A transverse electromagnetic horn antenna, comprising:

a) a horn comprising two electrically separate conductive plates, where each conductive plate comprises an interior surface nearest the other conductive plate and an exterior surface farthest from the other conductive plate; and b) resistive loading material mounted on the exterior surfaces of the conductive plates.

2. The transverse electromagnetic horn antenna of claim 1, wherein the two conductive plates are mounted with and angled away from each other, and wherein each conductive plate has a cross-section with substantial transverse width relative to the separation between the conductive plates.

3. The transverse electromagnetic horn antenna of claim 1, wherein the two conductive plates are mounted with and angled away from each other, and wherein each conductive plate has a convex cross-section.

4. The transverse electromagnetic horn antenna of claim 1, wherein the conductive plates are planar, and wherein each conductive plate has two lateral edges diverging from each other at a monotonically increasing angle, and wherein the conductive plates are mounted with and angled away from each other at a monotonically increasing separation angle.

5. The transverse electromagnetic horn antenna of claim 1, wherein the conductive plates are planar, and wherein each conductive plate has two lateral edges diverging from each other at a monotonically increasing angle, and wherein the conductive plates are mounted with and angled away from each other at a constant separation angle.

6. The transverse electromagnetic horn antenna of claim 1, wherein the conductive plates are planar, and wherein each conductive plate has two lateral edges diverging from each other at a constant angle, and wherein the conductive plates are mounted with and angled away from each other at a monotonically increasing separation angle.

7. The transverse electromagnetic horn antenna of claim 1, wherein the conductive plates are planar, and wherein each conductive plate has two lateral edges diverging from each other at a constant angle, and wherein the conductive plates are mounted with and angled away from each other at a constant separation angle.

8. The transverse electromagnetic horn antenna of claim 1, wherein the conductive plates are chosen from the group consisting of: solid metallic plates, printed wiring boards, dielectric with conductive coating, and combinations thereof.

9. The transverse electromagnetic horn antenna of claim 1, wherein the resistive loading material is chosen from the group consisting of: carbon-loaded lossy foam absorber, solid ferrite tiles, ferrite-particle loaded coating, carbon-particle loaded coating, thick film carbon sheet, and combinations thereof.

10. A transverse electromagnetic horn antenna, comprising:

a) a horn comprising two electrically separate conductive plates, where each conductive plate comprises an interior surface nearest the other conductive plate and an exterior surface farthest from the other conductive plate; and b) resistive loading material mounted on the exterior surfaces of the conductive plates;

wherein the horn has a feedpoint end and an aperture end, and wherein the resistive loading material mounts on the exterior surfaces of the conductive plates with outside edges of the resistive loading material inside the side edges of the conductive plates and extending from the aperture end of the conductive plates toward the feedpoint end of the horn antenna to a point not more than 80% of the length of the plates.

11. A method of making a transverse electromagnetic horn antenna, comprising the following steps, in any order:

a) mounting a first conductive plate with a second conductive plate, wherein the first and second conductive plates are separated by a first distance near a first end thereof and at a second distance near a second end thereof, the first distance being less than the second distance;

b) mounting resistive loading material with the exterior surfaces of the first and second conductive plates; and c) mounting a feedpoint adapted to connect to an external electromagnetic system with the first ends of the first and second conductive plates.

12. The method of making a transverse electromagnetic horn antenna of claim 11, wherein the step of mounting resistive loading material comprises mounting resistive loading material inside the outer edges of the first and second conductive plates.

13. The method of making a transverse electromagnetic horn antenna of claim 11, wherein the step of mounting resistive loading material comprises mounting resistive loading material with the second ends of the first and second conductive plates and extending toward the first ends of the first and second conductive plates.

14. A transverse electromagnetic horn antenna, comprising:

a) first and second conductive plates, where each conductive plate comprises a substantially planar triangle, and wherein the first conductive plate is mounted with and disposed at a first angle away from the second conductive plate;

b) resistive loading material mounted with the surfaces of the first and second conductive plates farthest from the other conductive plate, wherein the resistive loading material covers less than all of said surfaces; and c) feedpoint means mounted with the first and second plates for connecting an external electromagnetic system to the first and second conductive plates near their point of least separation.

15. The transverse electromagnetic horn antenna of claim 14, wherein the resistive loading material comprises strips mounted inside the lateral edges of the first and second plates and extending from the ends of the first and second conductive plates at their greatest separation toward the feedpoint means.

16. The transverse electromagnetic horn antenna of claim 14, wherein the resistive loading material comprises sheets covering a portion of said surfaces extending from the ends of the first and second conductive plates at their greatest separation toward the feedpoint means and having two lateral edges diverging from each other at substantially the same angle as the lateral edges of the conductive plate.

17. The transverse electromagnetic horn antenna of claim 14, further comprising a dielectric lens mounted with the conductive plates near the ends of the first and second conductive plates at their greatest separation.

* * * * *